United States Patent [19]

Gladwin

[11] 4,129,175

[45] Dec. 12, 1978

[54] CONTINUOUS SLAB CASTING MOLD

[76] Inventor: Floyd R. Gladwin, 21000 E. River Rd., Grosse Ile, Mich. 48138

[21] Appl. No.: 820,462

[22] Filed: Aug. 1, 1977

[51] Int. Cl.[2] ..... B22D 11/124; B22D 27/04

[52] U.S. Cl. ..... 164/444; 164/348

[58] Field of Search ..... 164/444, 418, 436, 82, 164/89, 443, 435, 297, 441, 442, 348, 422; 249/79

[56] References Cited

U.S. PATENT DOCUMENTS

| | | | |
|---|---|---|---|
| 3,515,202 | 6/1970 | Bick et al. | 164/444 X |
| 3,595,302 | 7/1971 | Mallener | 164/443 |
| 3,750,743 | 8/1973 | Barber | 164/418 X |
| 3,763,920 | 10/1973 | Auman | 164/443 X |
| 3,930,534 | 1/1976 | Wunnenberg et al. | 164/444 X |
| 3,931,848 | 1/1976 | Schmid | 164/89 X |
| 4,033,404 | 7/1977 | Schmid | 164/444 X |

OTHER PUBLICATIONS

German Printed Application, 1252371, 19 Oct., 1967.

*Primary Examiner*—Francis S. Husar
*Assistant Examiner*—John S. Brown
*Attorney, Agent, or Firm*—Cullen, Sloman, Cantor, Grauer, Scott & Rutherford

[57] ABSTRACT

A continuous slab casting mold having spaced apart forward and rear walls joined by opposed side walls to form an open top and bottom, roughly rectangular shaped box-like shape. The mold is cooled so that molten metal is received through the open top and continuously cast into slab while moving through the mold and downwardly out through the open bottom thereof. A downwardly depending extension plate is formed on each of the side walls for extending a considerable distance beneath the mold. The extension plates are provided with hollow interior chambers which communicate through holes to their interior faces for passing water from the chambers through the holes and upon the adjacent side edges of the cast slab immediately as such slab's side edge leaves the bottom of the mold.

4 Claims, 7 Drawing Figures

FIG.1
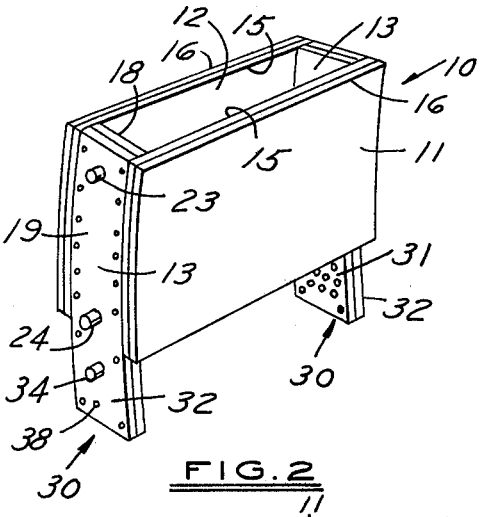
FIG.2
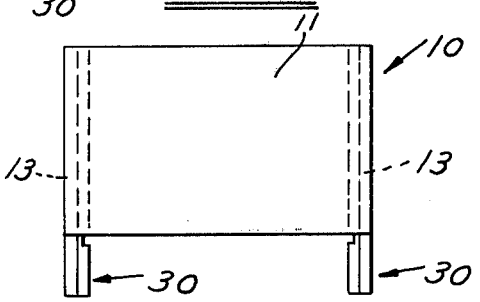
FIG.3
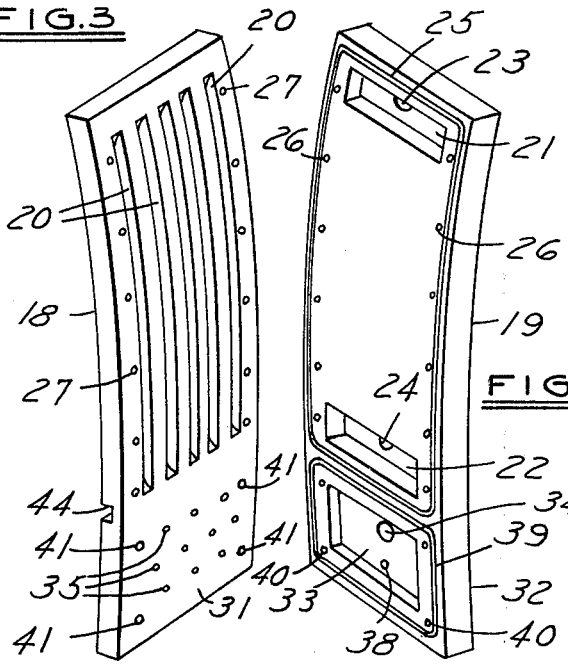
FIG.4
FIG.5
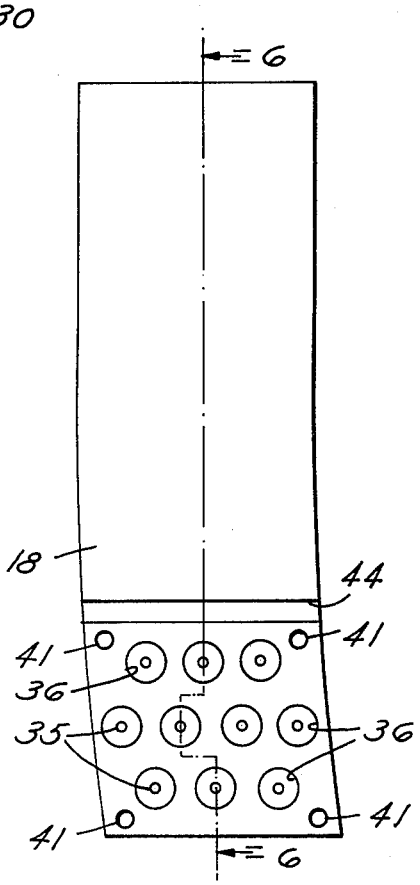
FIG.6
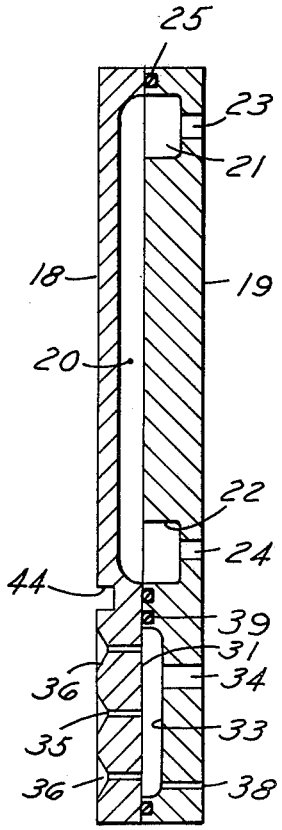
FIG.7
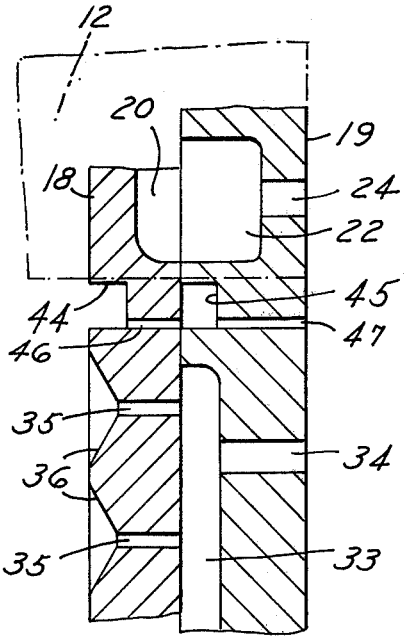

CONTINUOUS SLAB CASTING MOLD

BACKGROUND OF THE INVENTION

In the process of continuously casting steel slab, molten metal is poured into the open upper end of a box-like mold, within which the metal is cooled for continuously exiting through the open bottom end in a slab-like form. An example of a mold used for this process is illustrated in my prior U.S. Pat. No. 3,978,910 issued Sept. 7, 1976 and also in my prior U.S. Pat. No. 3,964,727 issued June 22, 1976.

In such molds, the molten metal adjacent the interior walls of the mold is chilled and a thin skin is formed on the metal. The interior of the metal slab remains molten. Thus, as the metal exits from the lower end of the mold, it is in the form of a relatively thin casing or skin of solidified metal surrounding an interior core of molten metal. The continuously moving slab is then cooled further until ultimately it is solidified throughout.

In a typical continuous casting operation, the metal is cast downwardly into the mold which basically is like a vertical tube of approximately rectangular cross section, and as the metal exits from the lower end of the tubular mold, it is curved, gradually, until it takes a full 90° bend at some distance from the mold, so that the continuous slab becomes horizontal for cutting and handling at the point where the metal is solidified.

A problem in continuously casting metal in the manner described above, is that as the metal exits from the lower end of the casting mold, its skin is sufficiently fragile that it may distort or bulge or rupture. Hence, it is desirable to cool such skin and thicken it as rapidly as possible to the point where it is reliably self-sustaining.

Prior cooling systems involved flowing water either upon the slab or through cooled rollers or plates for cooling the slab below the mold. However, such cooling has not been fully satisfactory to alleviate the problems caused by the relatively thin skinned slab emerging from the lower end of the mold in a fragile condition prior to further cooling.

Hence, the invention herein relates to an improved type of cooling system incorporated with the mold to alleviate the foregoing problem.

SUMMARY OF INVENTION

The invention herein contemplates forming side cooling means directly upon and as depending extensions of the side walls of the continuous casting mold for cooling the fragile continuous cast metal skin immediately at the lower end of the mold and for holding the skin against bulging and rupture and the like.

The mold side walls are made of an interior copper or copper-like plate which forms a sheathing or facing on the interior of the mold. Such plate is backed by a thick steel plate. The sheathing or facing plate is cooled as by means of forming interior channels or grooves which receive a constant flow of water from water inlet and outlet pockets formed in the steel backing plate. Thus, the side walls form a smooth, cool surface against which the molten metal is cast, moves and solidifies. The improvement herein contemplates extending downwardly, beneath the mold the side wall copper sheathing or facing and backing plates with the interior surface of the sheathing forming an extension of the surface of the sheathing of the side wall within the mold. If the interior surface is curved or bowed, as is the case sometimes, then the same surface configuration is continued beneath the mold upon the extension interior surface.

In addition, cooling means are provided in the wall lower extension in the form of a hollow water receiving pocket in the steel backing plate and holes through the copper-like sheathing through which the water may flow against the adjacent slab surface. In the way, the slab is cooled by water contact as contrasted with the cooling of the slab within the mold by means of cooling the mold wall itself. In view of the fact that the slab contracts, normally there is room between the slab surface or skin formed thereon and the interior surface of the wall downward extension. However, such interior wall surface serves to contact or steady or hold the slab skin against bulging or rupture as necessary.

As can be seen, the downward extension of the side walls forms a relatively inexpensive and effective cooling means at the point where the slab emerges downwardly out of the mold. Where the mold is vibrated or shaken, as in some types of processing, the extension cooling means moves with the mold and is therefore, always positioned to cool the slab immediately upon leaving the mold.

Since water is flowed against the slab on the interior of the wall extension, there is a likelihood that the water, either particles or vapor, may rise up or climb up the walls and into the mold where it is unwanted. To avoid this problem, a transverse groove is formed at the juncture between the mold side walls and the mold extension to serve as a relief or barrier for water and permit escape of the water before entering into the mold. This forms a simplified control against movement of unwanted water.

These and other objects and advantages of this invention will become apparent upon reading the following description, of which the attached drawings form a part.

DESCRIPTION OF DRAWINGS

FIG. 1 is a perspective view of a continuous casting mold with the side wall extensions formed thereon.

FIG. 2 is a front elevational view of the mold.

FIG. 3 is a perspective view of the copper-like sheathing or face plate forming a portion of the mold side wall, and FIG. 4 is a perspective view of the face of the steel back-up plate which mates with the illustrated sheathing or face plate of FIG. 3.

FIG. 5 is an elevational view of the interior surface of the side wall of the mold, including the extension.

FIG. 6 is a cross sectional view taken in the direction of arrow 6—6 of FIG. 5.

FIG. 7 is an enlarged, fragmentary, cross sectional view of a portion of the side wall showing a modified seal means.

DETAILED DESCRIPTION

FIG. 1 illustrates a mold 10 for continuously casting slab, such as molten steel casting. In the continuous casting process, the molten steel or other metal is poured into the upper end of the box-like or tubular mold which is formed of a front wall 11, a rear wall 12 and side walls 13. The walls are secured together in a conventional manner.

The metal begins to solidify within the mold, against the mold walls, forming a skin containing a molten metal core. The slab, that is the solidified skin surrounding the molten core, emerges from the bottom of the mold for cooling and ultimately cutting into appropriate sizes for further processing. The mold itself may be of substantial size, such as having an interior cavity of ten inches by fifty inches, which dimensions may vary considerably. In addition, the mold interior wall may be curved so that the slab emerging from the bottom of the mold begins turning from the vertical so that it may ultimately be turned 90°. Thus the slab becomes flat or horizontal for further processing.

The mold illustrated herein is similar to that shown in my prior U.S. Pat. No. 3,978,910 issued Sept. 7, 1976. Thus, the front and rear walls are formed of interior sheathing or facing copper or copper-like plates 15 and exterior steel backing plates 16. The side walls each are formed of a side wall face or sheath interior plate 18 formed of copper or copper-like material, also backed with a steel backing plate 19, as illustrated in FIGS. 3 and 4.

The inside face of the plate 18 is formed with channels 20 whose upper ends align with an upper pocket 21 formed in the adjacent face of the backing plate 19. Likewise, the channels have lower ends aligned with a lower pocket 22 formed in the backing plate.

An inlet pipe opening 23 delivers cold water or similar coolants to the upper pocket 21 so that the water circulates through the channels 20 and out through the lower pocket 22 and an outlet pipe 24 which drains the lower pocket. In that manner, the copper interior face plate 18 is cooled for thereby cooling the molten metal and causing solidification thereof.

The plates 18 and 19 are sealed together by means of a sealing strip 25 arranged within a continuous shallow groove formed in the backing plate 19. Aligned both holes 26 and 27 in the respective plates 18 and 19 accomodate conventional bolts for fastening the two plates together.

The improvement herein, invloves extending the copper plate 18 and the backing plate 19 beneath the lower edge of the mold to form side extensions or side shoes 30 each comprising a copper or copper-like face plate 31 and a steel back plate 32 which may be integral with their respective plates 18 and 19 or may be separate pieces secured thereto.

A plenum or chamber 33 is formed in the back plate 32 for receiving water or other coolant through an entry pipe 34. The water then flows through holes 35 having countersunk open ends 36 formed in the face plate for thereby applying the water to the adjacent surface of the slab.

One or more small weep holes 38 are formed in the chamber 33 to constantly leak water and thereby avoid a pressure build-up within the chamber in the event that the holes 35 happen to plug up during operation.

A sealing strip 39 similar to strip 25 is provided between the extension plate portions 31 and 32 and bolt holes 40 and 41 accomodate bolts for fastening those two plate portions together with conventional bolts.

During operation when water under pressure, such as twenty gallons per minute flow, sprays out through the holes 35 in each extension, there is a tendency for the water to rise upwardly within the mold and flow between the side wall of the mold and the metal being cast which presents problems. To control the tendency of the water to flow upwardly, a transverse groove 44 extends the width of the side walls, at the juncture between the extension and the lower edge of the side walls to thereby act as a barrier against and relief passage for water tending to rise upwardly.

That same type of relief or barrier groove may be used between the copper face plate and steel backing plate as illustrated by transverse groove 45 in the modification of FIG. 7 wherein such a groove is either substituted for or used in addition to the sealing strip portion located between the extension and the main portion of the steel backing plate, to safeguard against leakage through the sealing strips. Preferably, weep holes 46, through plate 18, connect groove 44 to groove 45. Further weep holes 47 extend through plate 19 from grooves 45. Thus, the weep holes 46 and 47 drain the grooves 44 and 45.

The embodiment of FIG. 7 is otherwise identical to the structure described above.

Having fully described an operative embodiment of this invention, I now claim:

1. In a continuous slab casting mold formed of a pair of spaced apart mold front and rear plate members and a pair of mold side plate members secured together to form an open top and bottom, roughly rectangular shaped in cross-section, mold for receiving molten metal through the open top and continuously casting metal slab through the mold and downwardly out through the open bottom thereof, and each of said mold side plate members including an interior plate for contacting and molding the metal slab side edges, and an exterior backing plate for the interior plate, the improvement comprising:

an extension plate formed on the lower edge of and depending downwardly a considerable distance from each of the side plate members;

and said extension plates each including a face plate having an interior face which faces toward the slab side edge extending beneath the mold bottom and which is substantially co-planar with and forms a depending extension of the interior surface of the mold side member interior plate;

and said extension plates each including an exterior back plate secured to and backing its respective face plate;

a hollow chamber within each of said extension plates and formed by a hollowed out portion in the backing plate which is covered by its respective face plate, and holes communicating said chamber with said interior surface, and a cooling fluid inlet connected to said hollow chamber for continuously flowing coolant through the chamber and holes to the adjacent slab edge surface;

and including a horizontal groove near the bottom edge of the mold extending the width of and formed in the interior surface of each extension plate for forming a barrier against coolant rising upwardly into the mold from the extension plates.

2. A construction as defined in claim 1, and including a second horizontal groove formed between the backing plate and the interior plate of the extension at about the beginning of the extension plate, i.e., at the lower edge of the mold for forming a barrier against coolant rising upwardly between the extension face and exterior backing plates, and weep openings connecting the grooves and draining the second groove.

3. In a continuous slab casting mold formed of a pair of spaced apart mold front and rear plate members and a pair of mold side plate members secured together to form an open top and bottom, roughly rectangular shaped in cross-section, mold for receiving molten metal through the open top and continuously casting metal slab through the mold and downwardly out through the open bottom thereof, and each of said mold side plate members including an interior plate for contacting and molding the metal slab side edges, and an exterior backing plate for the interior plate, the improvement comprising:

an extension plate formed on the lower edge of and depending downwardly a considerable distance from each of the side plate members;

and said extension plates each including a face plate having an interior face which faces toward the slab side edge extending beneath the the mold bottom and which is substantially co-planar with and forms a depending extension of the interior surface of the mold side member interior plate;

and said extension plates each including an exterior back plate secured to and backing its respective face plate;

a hollow chamber within each of said extension plates and formed by a hollowed out portion in the backing plate which is covered by its respective face plate, and holes communicating said chamber with said interior surface, and a cooling fluid inlet connected to said hollow chamber for continuously flowing coolant through the chamber and holes to the adjacent slab edge surface;

and including a horizontal groove formed between the backing plate and the interior plate of the extension at about the beginning of the extension plate, i.e., at the lower edge of the mold for forming a barrier against coolant rising upwardly between the extension face and exterior backing plates.

4. In a continuous slab casting mold formed of a pair of spaced apart mold front and rear plate members and a pair of mold side plate members secured together to form an open top and bottom, roughly rectangular shaped in cross-section mold for receiving molten metal through the open top and continuously casting metal slab through the mold and downwardly out through the open bottom thereof, and each of said mold side plate members including an interior plate having an interior surface for contacting and molding the metal slab side edges, and an exterior backing plate for the interior plate, the improvement comprising:

an extension plate formed on the lower edge of, as a continuation of, and depending downwardly a considerable distance from each of the side plate members;

and said extension plates each including an interior face plate forming a depending continuation extension of said mold side plate member interior plate, and having a continuous interior face which faces towards the slab side edge extending beneath the mold bottom and which continuous interior face is substantially co-planar with and forms a depending continuation extension of the interior surface of the mold side member interior plate;

and said extension plates each including an exterior back plate portion depending from said mold side plate member exterior backing plate and secured to and backing its respective face plate;

a hollow chamber formed within each of said extension plates by a hollowed out portion in the backing plate which is covered by its respective face plate, and numerous relatively small diameter, spaced apart holes extending through each of said interior face plates and communicating said chamber with said face plate interior surface, and a cooling fluid inlet connected to said hollow chamber for continuously flowing coolant into the chamber and out through the numerous holes to the face plate interior surface to thereby spray the coolant upon the adjacent slab edge surface.

* * * * *